US007472449B2

(12) United States Patent
Orban

(10) Patent No.: US 7,472,449 B2
(45) Date of Patent: Jan. 6, 2009

(54) REVERSIBLE WALL-MOUNTED PILLOW WITH TEXTURED SCRUBBING SURFACES

(76) Inventor: John J. Orban, 339 Allison Dr., Torrington, CT (US) 06790

( * ) Notice: Subject to any disclaimer, the term of this patent is extended or adjusted under 35 U.S.C. 154(b) by 714 days.

(21) Appl. No.: 10/975,281

(22) Filed: Oct. 27, 2004

(65) Prior Publication Data

US 2005/0091776 A1 May 5, 2005

Related U.S. Application Data

(60) Provisional application No. 60/515,865, filed on Oct. 30, 2003.

(51) Int. Cl.
*A47K 7/02* (2006.01)

(52) U.S. Cl. ..... 15/210.1; 15/104.92; 15/244.3; 4/606; 601/136

(58) Field of Classification Search ..... 15/104.92, 15/210.1, 244.3; 4/606; 601/136
See application file for complete search history.

(56) References Cited

U.S. PATENT DOCUMENTS

| | | | | | |
|---|---|---|---|---|---|
| 3,478,369 | A | * | 11/1969 | Ensley | 4/606 |
| 3,750,226 | A | * | 8/1973 | Morgan | 15/187 |
| 4,699,127 | A | * | 10/1987 | Schley | 601/136 |
| 5,311,635 | A | | 5/1994 | Moore | |
| 5,312,666 | A | * | 5/1994 | Jovanovic | 428/76 |
| 5,490,302 | A | | 2/1996 | Dion | |
| 5,600,864 | A | | 2/1997 | Huber | |
| 5,628,083 | A | | 5/1997 | Hayes | |

* cited by examiner

*Primary Examiner*—Randall Chin
(74) *Attorney, Agent, or Firm*—McCormick, Paulding & Huber LLP

(57) ABSTRACT

An inflatable plastic pillow with exfoliating surface on one side having a roughness at least as great as that of human skin, for use with exfoliating gels. The pillow is attachable to a shower wall with suction cups and reversible so that a massaging surface of greater roughness may also be used. The pillow provides a conformable cushion of air so that a user can move the body against the exfoliating surface held in place by the suction cups.

11 Claims, 3 Drawing Sheets

REVERSIBLE WALL-MOUNTED PILLOW WITH TEXTURED SCRUBBING SURFACES

CROSS REFERENCE TO RELATED APPLICATIONS

Figure 1:
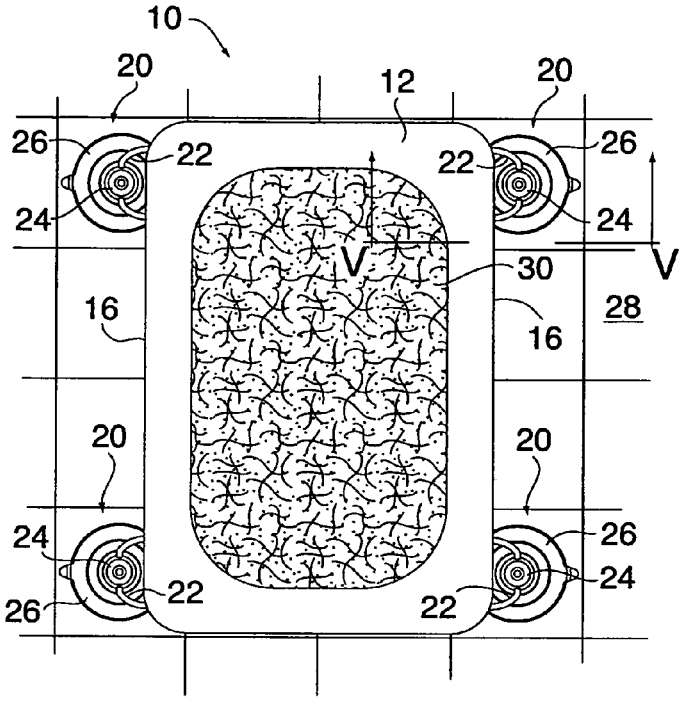

This application claims the benefits of prior filed, co-pending provisional U.S. patent application Ser. No. 60/515,865 filed on Oct. 30, 2003.

BACKGROUND OF THE INVENTION

This invention relates generally to a skin care and cleansing device to be used in conjunction with skin cleansing soaps and gels and exfoliating gels while taking a shower or bathing. More particularly, the invention relates to an inflatable or conformable pillow with textured scrubbing surfaces and means for holding the pillow in place.

Exfoliating gels have become popular for use in the shower or bath to aid in cleansing the skin and removing dead skin cells. Such exfoliating gels generally comprise a proprietary formulation of a liquid carrier containing cleansing agents and miniscule exfoliating abrasive particles that abrade and remove the dead skin cells as the gel is massaged into the skin with the hands. An example of such a gel is St. Ives "Apricot Scrub" manufactured by St. Ives Laboratories, Inc. Another such exfoliating gel is Ohm, manufactured by Proctor & Gamble. There are many such products on the market and they all have the common characteristic of a fluid carrier containing tiny abrasive particles. The precise formulation is not material to the present invention.

There are situations when an accessory device would be desirable to use in conjunction with exfoliating gels while taking a shower or bathing. For example, one cannot scrub one's back or, in some cases, a handicapped person cannot reach all parts of the body. It would also be desirable to provide a scrubbing surface which is ideally suited for enhancing the scrubbing or exfoliating action of the gel. In some cases, a more vigorous massaging surface would be useful for cleansing the skin and, in all cases, it would be desirable to carry out the scrubbing with a device having anti-microbial properties.

A number of prior art patents disclose back scrubbing devices to be attached to a shower wall by suction cups. U.S. Pat. No. 5,311,635 issued May 17, 1994 to Moore discloses a sponge rubber member attached to a backer board and covered with water-resistant carpeting material. U.S. Pat. No. 5,600,864 issued Feb. 11, 1997 to Huber discloses a reversible pad with two different cleaning surfaces and detachable suction cups. U.S. Pat. No. 5,490,302 issued Feb. 13, 1996 to Dion describes a foam pad mounted to a rigid plate used in conjunction with an inflatable bladder, and using a standard washcloth for massaging.

Lastly, U.S. Pat. No. 5,628,083 issued May 13, 1997 to Hayes discloses a device including a foam panel attached to a rigid back and covered with water impervious PVC. A water pervious cover sheet holds closed cell foam block members for cleansing or application of balm.

The above devices require rigid back support members with sponges, washcloths or similar applicators for holding lotion or soap, or using simple scrubbing surfaces. None are designed to work specifically with exfoliating gels.

Accordingly, one object of the present invention is to provide an improved conformable device with an exfoliating scrubbing surface to be used in conjunction with exfoliating gels.

Another object of the invention is to provide an improved cleansing device to be mounted on a stationary surface to assist in reaching inaccessible parts of the body.

Another object of the invention is to provide an improved inflatable shower and/or tub mounted pillow that is reversible having two types of scrubbing surfaces.

Still another object of the invention is to provide an improved cleansing device with anti-microbial properties.

SUMMARY OF THE INVENTION

Briefly stated, the invention comprises an exfoliating pillow with pillow holders adapted for temporary mounting on a stationary surface, the pillow comprising a flexible nonporous polymeric film having an external exfoliating surface extending over an effective scrubbing area thereof, the film being disposed over a cushion of air or elastomeric foam. The exfoliating surface defines a surface texture with an average roughness at least as great as that of human skin. Preferably, the pillow further includes an external massaging surface on its other side extending over an effective massaging area, the massaging surface defining an average surface roughness substantially greater than that of the exfoliating surface. The pillow holders are reversible and arranged to selectively expose either the scrubbing area or the massaging area to a user and to allow a selected side of the pillow to conform to the shape of a body member or the body of a user.

DRAWINGS

Figure 2:
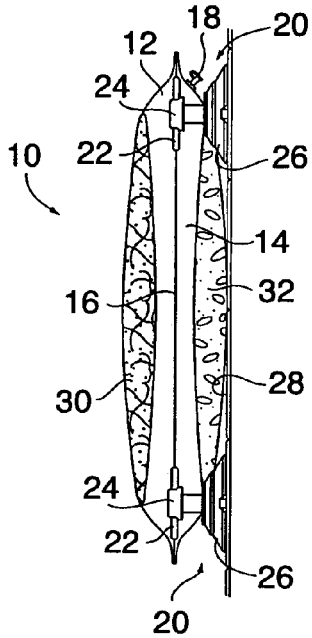
Figure 3:
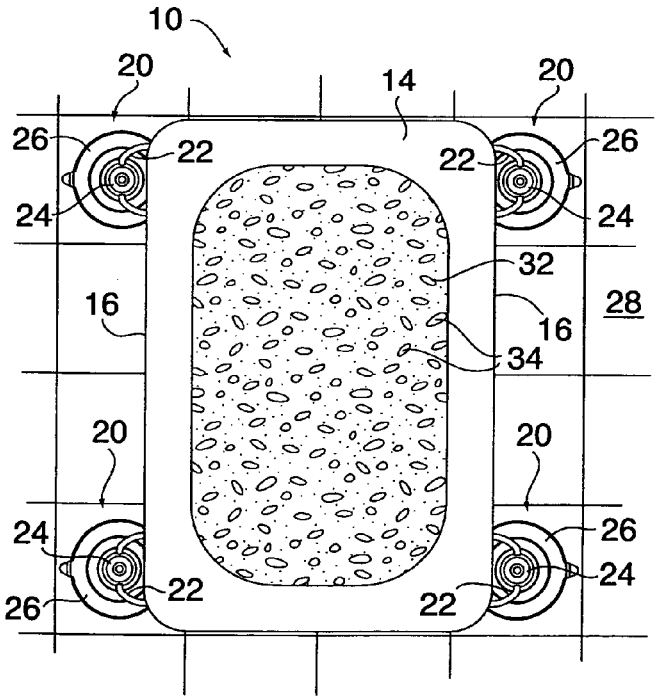
Figure 4:
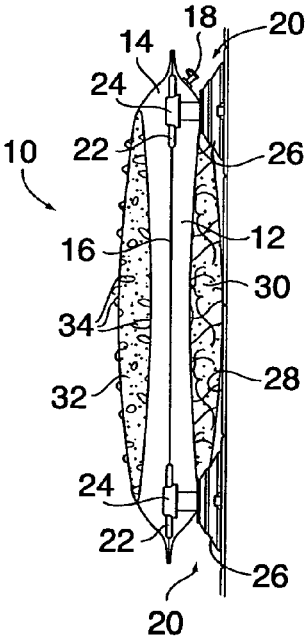
Figure 5:
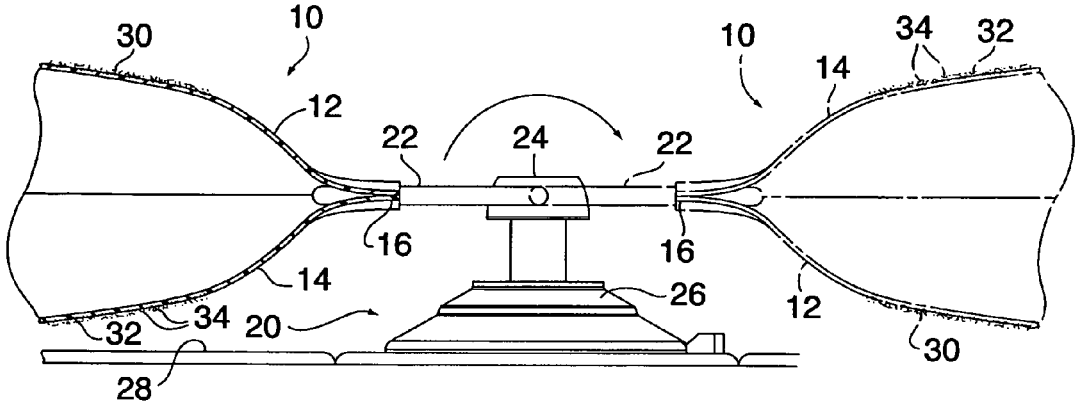
Figure 6:
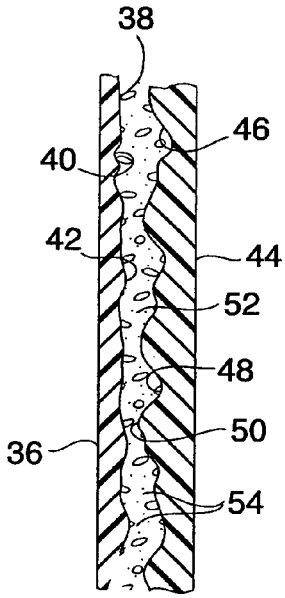
Figure 7:
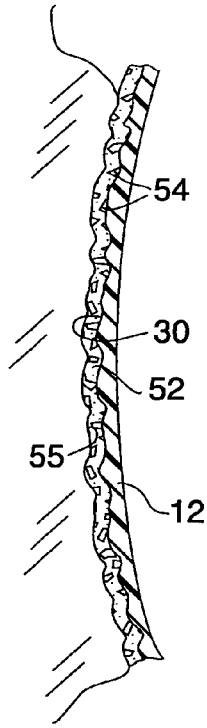
Figure 8:
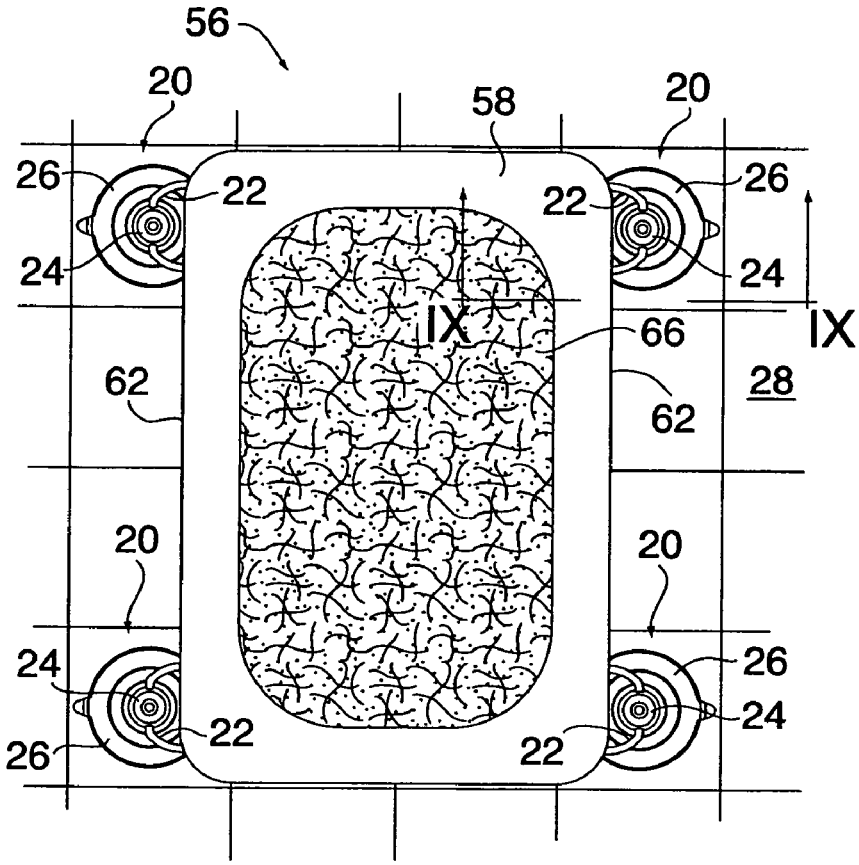
Figure 9:
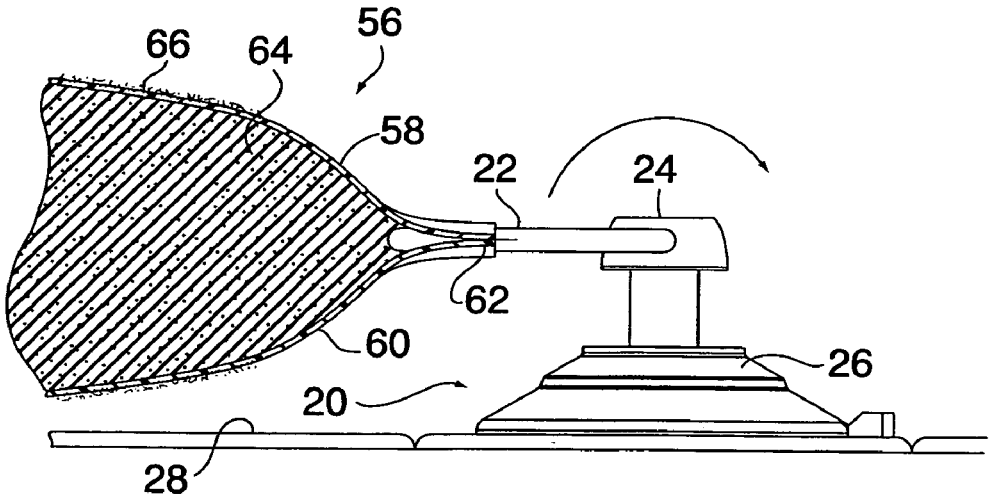

The invention will be better understood by reference to the following description, taken in connection with the accompanying drawings, in which:

FIG. 1 is a front elevation view of the inflatable pillow according to the present invention mounted on a tile shower wall, with exfoliating surface exposed, FIG. 2 is a side elevation view of the pillow of FIG. 1, FIG. 3 is a front elevation view of the same pillow reversed with a massaging surface exposed, FIG. 4 is a side elevation view of the pillow of FIG. 3, FIG. 5 is an enlarged view of the pillow holder with a partial cross sectional view of the pillow taken along lines V-V of FIG. 1, FIG. 6 is an idealized diagrammatic view, in cross section, of two opposed rubbing surfaces separated by an exfoliating gel, FIG. 7 is a cross sectional view taken through a portion of the inflatable pillow in contact with the skin of a user of an exfoliating gel, FIG. 8 is a front elevation view of a modification of the invention, and FIG. 9 is an enlarged view of the modified pillow, taken along lines IX-IX of FIG. 8.

DETAILED DESCRIPTION

Referring now to FIGS. 1 and 2 of the drawing, an inflatable pillow, shown generally at 10 comprises two sheets of flexible nonporous polymeric film, such as PVC. A first rectangular sheet 12 is joined to a second rectangular sheet 14 of the same size, and sealed around the edges 16 in a well known manner to provide an air tight inflatable bag or pillow. A conventional valve 18 is provided to inflate the pillow to provide a cushion of air.

Pillow 10 is provided with four pillow holders 20, which are identical in construction. A support ring 22 extends between the first and second sheets 12, 14 and is held in place by a suitable adhesive or thermal welding. A swivel bushing 24 is mounted on the exposed part of the ring and the bushing supports a suction cup 26. Four such suction cups 26 serve to adhere the pillow and support it from a stationary surface such as a tiled shower wall 28.

Since shower wall tiles are generally standardized as 4-inch squares, the pillow holders 20 are arranged on pillow 10 such that bushings 24 are spaced both horizontally and vertically at selected multiples of four inches. The suction cup diameters are less than 4 inches, so that they can be centered in the squares without overlapping the edges.

In accordance with one aspect of the present invention, the first sheet 12 of the polymeric film is textured by well known embossing techniques to provide an external exfoliating surface 30 extending over an effective scrubbing area comprising the major part of the first sheet 12. The second sheet 14, which is against the shower wall 28 is also embossed or molded to provide an external massaging surface 32 comprised of tiny bumps 34 protruding from the surface.

FIGS. 3 and 4 illustrate the same pillow 10. It has been reversed by rotating the suction cups 26 around the bushings 24 of holders 20. In FIGS. 3 and 4, the external massaging surface 32 is exposed and the exfoliating surface 30 is against the shower wall 28.

Reference to FIG. 5 of the drawing indicates a pillow holder 20 with ring 22 adhered between first sheet 12 and second sheet 14 of the inflatable pillow. As indicated by the arrow, suction cup 26 may be rotated, so that either sheet 12 or sheet 14 is uppermost.

Reference to FIG. 6 of the drawing shows an idealized view of two irregular rubbing surfaces separated by an exfoliating gel. A left hand member 36 has a surface 38 of lesser average roughness comprised of random valleys 40 and peaks 42. A right hand member 44 has a surface 46 of greater average roughness comprised of random valleys 48 and peaks 50. The average profile height (height from peak to valley) of surface 46 is significantly greater than the average profile height of surface 38.

Interposed between the surfaces 38, 46 is an exfoliating gel comprising a fluid carrier 52 containing abrasive exfoliating particles 54. Both surfaces 38 and 46 are abraded by movement of member 36 with respect to member 44 as particles 54 either roll from one valley to the next or are held by a peak on one surface and rub across a peak on the opposed surface. It should be readily apparent that the greater roughness of surface 46 of member 44 causes it to restrict movement of the particles more than surface 38 of member 36. More abrasion takes place on the surface of member 36 having lesser roughness, assuming that the materials from which idealized members 36 and 44 are constructed.

Reference to FIG. 7 illustrates a cross section through the skin of a user of the inflatable pillow 10 with exfoliating surface 30 against a human skin surface 55. A portion of the polymeric film 12 is supported by an air cushion so that it can conform to the contour of the user's body. An exfoliating gel comprising fluid 52 with abrasive exfoliating particles 54 is interposed between the user's skin surface 55 and the exfoliating surface 30. FIG. 7 illustrates the concept of FIG. 6, described above, where the rubbing surfaces comprise the exfoliating surface 30 on the pillow 10 on one side and the human skin surface 55 on the other side, with an exfoliating gel disposed therebetween.

In accordance with the present invention, the surface texture of exfoliating surface 30 is selected such that it has an average surface roughness at least as great as that of human skin. I have found that a suitable surface texture for exfoliating surface 30 comprising a random texture of peaks and valleys has a profile height (height from peak to valley), which varies between 0.001 inches and 0.009 inches. The distance between peaks varies between 0.005 inches and 0.100 inches. Width of valleys at the top opening may be on the order of 0.005 inches. The distance between valleys may be on the order of 0.100 inches.

FIGS. 8 and 9 illustrate a modified form of the invention using an alternate form of conformable pillow, shown generally at 56. Rather than using an air cushion interposed between the wall surface and the user, first and second sheets 58, 60 of polymeric film are joined around their peripheral edges 62 as before to enclose an elastomeric conformable pad 64. Sheets 58 and 60 may be identical to the previously described sheets 12 and 14 respectively. Sheet 58 defines an external exfoliating surface 66 extending over an effective scrubbing area and has an average roughness at least as great as that of human skin.

Elastomeric pad 64 may be formed by a conventional foaming process from any of the well-known polymers suitable for conforming ability, such as polyurethane foam. The foam may be open cell and will not absorb water during the scrubbing process, because it is sealed between the non-porous polymeric sheets 58, 60. While pad 64 is shown as a single member, separate foam particles or plastic beads might also be employed to provide a conformable pillow.

In operation, the pillow is attached by the suction cups of the pillow holders to a shower wall at a convenient height to massage the body. An exfoliating gel is applied to the exfoliating surface of the pillow. A user moves the body or a body member from side-to-side and up and down against the conformable pillow surface. The pillow may be moved to another location and/or reversed to expose the massaging surface for more vigorous scrubbing.

Since the average roughness of the textured surface 30 is at least as great as that of human skin, the surface in conjunction with the exfoliating gel will accomplish an effective job of cleansing and abrading skin surface 55. Also the polymeric film is much tougher than human skin and will continue to act effectively for a long period of time, and may have antimicrobial properties as well.

Other modifications will occur to those skilled in the art and it is desired to secure all such modifications as fall within the true spirit and scope of the invention.

The invention claimed is:

1. An exfoliating pillow for use with an exfoliating bath gel to enhance the scrubbing action of the gel, said exfoliating pillow comprising:

a pillow member arranged to provide a conformable cushion, a flexible non-porous film disposed on both sides of said conformable cushion, the film on one side thereof defining an external exfoliating surface extending over an effective scrubbing area thereof, and the film on the other side defining an external massaging surface extending over an effective massaging area, and a plurality of pillow holders connected to said pillow member and adapted to temporarily mount said pillow member onto a stationary surface with said conformable cushion against the stationary surface so as to support said film and to conform to a body member of a user moving against the film while scrubbing the skin of the user, and wherein said pillow holders are arranged to mount said pillow with either selected side thereof disposed to face a user and the other side thereof disposed adjacent the stationary surface.

2. The exfoliating pillow of claim 1, wherein said pillow holders comprise suction cups on swivel mountings arranged to reverse the selected side of said pillow member.

3. The exfoliating pillow of claim 1, wherein the exfoliating surface defines a surface texture with an average roughness at least as great as that of human skin.

4. The exfoliating pillow of claim 1, wherein the pillow member comprises an inflatable plastic pillow with an air valve.

5. The exfoliating pillow of claim 1, wherein the pillow member comprises an elastomeric polymeric foam.

6. The exfoliating pillow of claim 1, wherein said film is a polymeric film and wherein the exfoliating surface is embossed with a random texture of peaks and valleys.

7. The exfoliating pillow of claim 6, wherein the profile height from peak to valley varies between 0.001 inches and 0.009 inches.

8. The exfoliating pillow of claim 1, wherein said film is a polymeric film, wherein the exfoliating surface is embossed with a random texture of peaks and valleys having a surface texture with an average roughness at least as great as that of human skin.

9. The exfoliating pillow of claim 8, wherein the massaging surface defines an average surface roughness substantially greater than that of human skin.

10. An exfoliating pillow for use with an exfoliating bath gel to enhance the scrubbing action of the gel, said exfoliating pillow comprising:

an inflatable pillow member having a periphery and arranged to provide a conformable air cushion, a flexible non-porous film disposed on both sides of said conformable air cushion, the film on one side defining an external exfoliating surface extending over an effective scrubbing area thereof, and the film on the other side defining an external massaging surface extending over an effective massaging area, a plurality of pillow holders connected about the periphery of said pillow member and adapted to temporarily mount said pillow member onto a stationary surface with said conformable air cushion against the stationary surface so as to support said film and to conform to a body member of a user moving against the film while scrubbing the skin of the user, and wherein said pillow holders are arranged to mount said pillow member with either selected side thereof disposed to face a user and the other side thereof disposed adjacent the stationary surface.

11. The exfoliating pillow of claim 10, wherein said pillow holders comprise suction cups on swivel mountings arranged to reverse the selected side of said pillow member.

* * * * *